US006146466A

United States Patent [19]

Bowers

[11] Patent Number: 6,146,466

[45] **Date of Patent: *Nov. 14, 2000**

[54] USE OF ELECTROSTATIC BIAS TO CLEAN NON-ELECTROSTATICALLY SENSITIVE COMPONENTS WITH A CARBON DIOXIDE SPRAY

[75] Inventor: Charles W. Bowers, Torrance, Calif.

[73] Assignee: ECO-Snow Systems, Inc., Livermore, Calif.

[ * ] Notice: This patent is subject to a terminal disclaimer.

[21] Appl. No.: 08/816,954

[22] Filed: Feb. 14, 1997

[51] Int. Cl.[7] ..... B08B 6/00

[52] U.S. Cl. ..... 134/1; 134/1.3; 134/2; 134/6; 134/7; 134/902; 451/38; 451/39; 451/75; 451/78; 451/102

[58] Field of Search ..... 451/38, 39, 75, 451/78, 102; 134/1, 2, 1.3, 6, 7, 902

[56] References Cited

U.S. PATENT DOCUMENTS

| | | | |
|---|---|---|---|
| 4,132,567 | 1/1979 | Blackwood | 134/1 |
| 4,535,576 | 8/1985 | Shukla et al. | 51/413 |
| 4,974,375 | 12/1990 | Tada et al. | 51/413 |
| 5,190,064 | 3/1993 | Aigo | 134/81 |
| 5,202,008 | 4/1993 | Talich et al. | 451/38 |
| 5,364,472 | 11/1994 | Heyns et al. | 134/7 |
| 5,409,418 | 4/1995 | Krone-Schmidt et al. | 451/75 |
| 5,421,766 | 6/1995 | Shank, Jr. | 451/75 |
| 5,480,563 | 1/1996 | Mitsumori et al. | 210/748 |
| 5,601,478 | 2/1997 | Mesher | 451/75 |
| 5,605,484 | 2/1997 | Bailey et al. | 445/59 |
| 5,628,463 | 5/1997 | Nakamura | 239/690 |
| 5,651,834 | 7/1997 | Jon et al. | 134/31 |
| 5,784,905 | 8/1998 | Townsend et al. | 68/13 R |
| 5,837,064 | 11/1998 | Bowers | 134/6 |

*Primary Examiner*—Jill Warden
*Assistant Examiner*—S. Carrillo
*Attorney, Agent, or Firm*—R. Craig Armstrong

[57] ABSTRACT

An apparatus and method that enhances removal of contaminating particles from surfaces of a non-electrostatically sensitive components that are cleaned using a carbon dioxide cleaning spray. The apparatus includes a programmable power supply that is connected to ground and to the non-electrostatically sensitive component. The surface charge of the component is determined by cleaning the surface without adding any voltage or charge bias to the component. Then the surface is reversed-biased with a voltage having the opposite polarity by a large amount using the programmable power supply. The surface is then cleaned a second time, which removes the contaminating particles that were bound to the surface by electrostatic forces generated during the first cleaning. Thus, reversing the polarity of the charge on the surface that is to be cleaned removes the strong attraction between the contaminating particles and the surface and enhances removal of the contaminating particles from the surface.

3 Claims, 1 Drawing Sheet

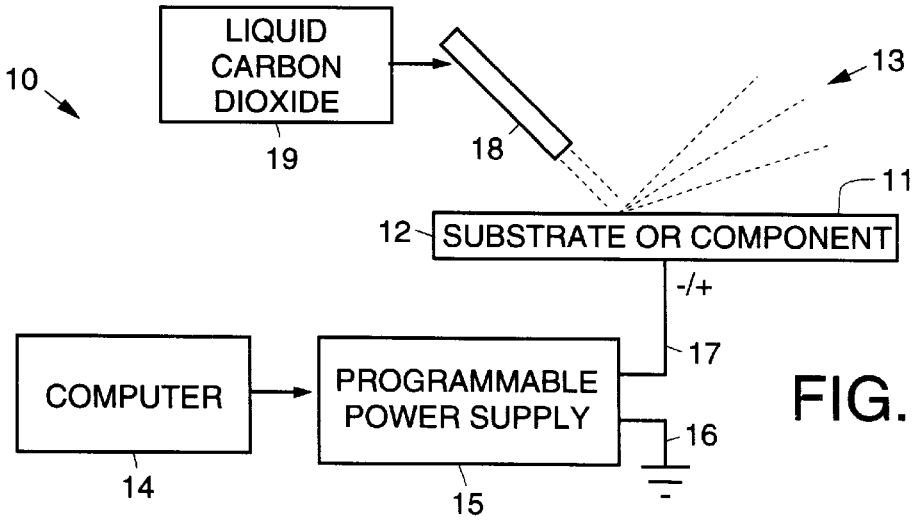
FIG. 1
FIG. 2
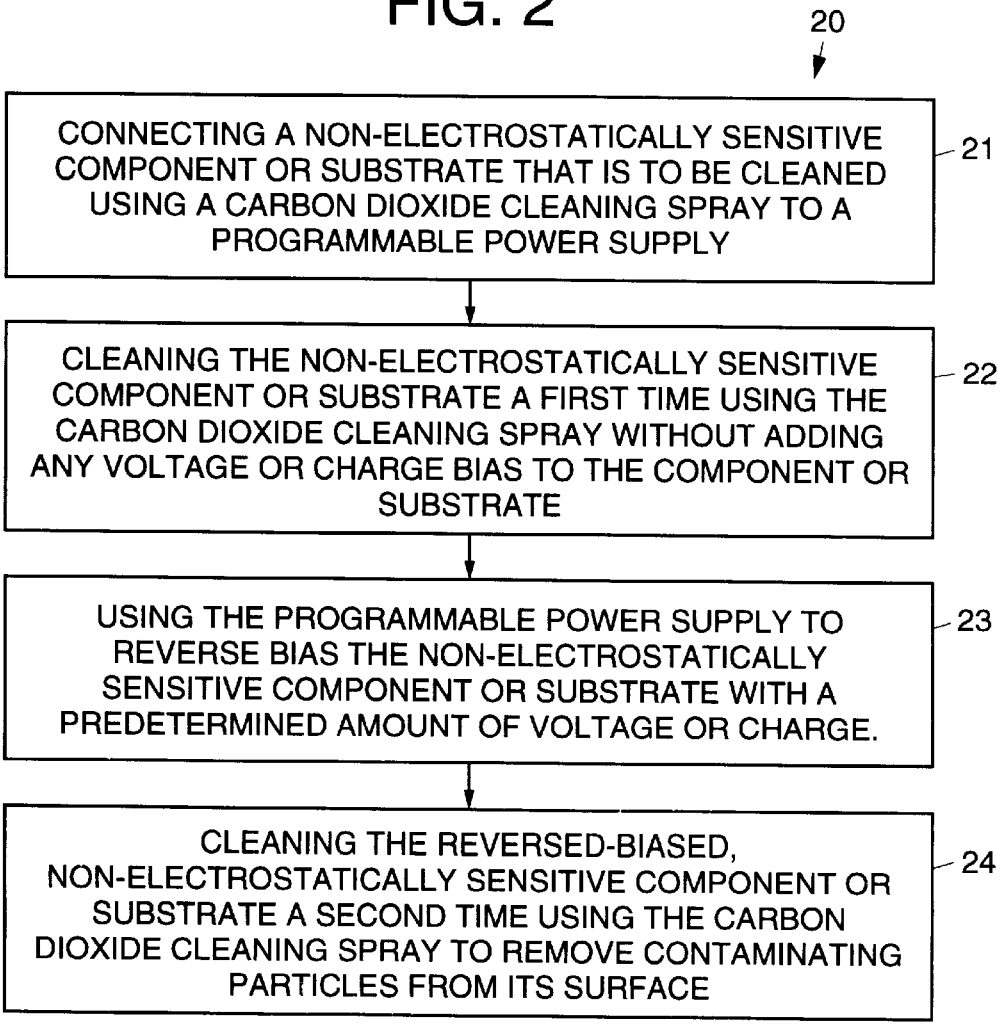

USE OF ELECTROSTATIC BIAS TO CLEAN NON-ELECTROSTATICALLY SENSITIVE COMPONENTS WITH A CARBON DIOXIDE SPRAY

BACKGROUND

The present invention relates generally to cryogenic aerosol spray cleaning, and more particularly, to an apparatus and method of enhancing the removal of contaminating particles on surfaces of a non-electrostatically sensitive components or substrates when they are cleaned using a carbon dioxide cleaning spray.

The assignee of the present invention manufactures and sells cryogenic aerosol spray cleaning equipment, such as carbon dioxide ($CO_2$) jet spray cleaning equipment, for example, under the ECO-SNOW™ brand. The carbon dioxide jet spray cleaning equipment uses a jet spray nozzle and orifice combination fed from a pressurized liquid carbon dioxide tank to generate a spray of $CO_2$ snow containing solid aerosol particles and gas. Selection of the particular nozzle and orifice combination and tank pressure determines the aggressiveness of the snow when it is used to clean surfaces contaminated with particulates.

It is known that cryogenic aerosol spray cleaners generate static charge on surfaces of components during cleaning. Unfortunately, the static charge buildup hinders removal of the contaminating particles from the surface of the component by the cryogenic aerosol spray. This is because the static charge buildup increases the attraction between the surface of the component and the contaminating particles that the cryogenic aerosol spray intends to remove.

It would therefore be desirable to enhance and improve the cleaning action of carbon dioxide sprays by augmenting the kinetic energy transfer of solid carbon dioxide particles with a repulsive electrostatic force.

Accordingly, it is an objective of the present invention to provide for an apparatus and method of enhancing the removal of contaminating particles on surfaces of a non-electrostatically sensitive components or substrates when they are cleaned using a carbon dioxide cleaning spray.

SUMMARY OF THE INVENTION

To meet the above and other objectives, the present invention provides for an apparatus and method that enhances removal of contaminating particles from surfaces of non-electrostatically sensitive components or substrates that are cleaned using a carbon dioxide cleaning spray. The apparatus comprises a computer that is coupled to a programmable power supply that has its outputs coupled to ground and to a non-electrostatically sensitive component or substrate that is to be cleaned using the carbon dioxide cleaning spray. The present invention generates an electrostatic force that is used to repel small contaminating particles from the surface of the contaminated component or substrate during carbon dioxide spray cleaning.

The contaminating particles are bound by strong electrostatic forces to the surface of the non-electrostatically sensitive component or substrate that is to be cleaned. Reversing the polarity of the charge on the surface that is to be cleaned removes this strong attraction between the contaminating particles and the surface and enhances removal of the contaminating particles from the surface.

Using the present invention, the surface charge of the component or substrate is determined by cleaning the surface without adding any voltage or charge bias to the component. Then the surface is biased with a voltage having the opposite polarity by a large amount. The computer is used to program the programmable power supply to appropriately reverse bias the component or substrate. The surface is then cleaned a second time, which removes the particles that were bound to the surface by electrostatic forces generated during the first cleaning.

It is necessary for the surface of the component or substrate to be biased both positively and negatively, because materials charge in accordance with their relative positions on the Triboelectric scale relative to the position of the aerosol spray on the Triboelectric scale. Materials such as Teflon, for example, can have thousands of volts of static charge build-up after cleaning, while metals tend to have much less static charge build-up and associated static charge related cleaning problems.

The present method comprises the following steps. A non-electrostatically sensitive component or substrate that is to be cleaned using a carbon dioxide cleaning spray is connected to a programmable power supply. The non-electrostatically sensitive component or substrate is then cleaned a first time using the carbon dioxide cleaning spray without adding any voltage or charge bias to the component or substrate. The programmable power supply is then programmed to reverse bias the non-electrostatically sensitive component or substrate with a predetermined amount of voltage or charge. The amount of voltage or charge applied to the component or substrate depends upon the material from which it is made. The reversed-biased, non-electrostatically sensitive component or substrate is then cleaned a second time using the carbon dioxide cleaning spray, which removes contaminating particles from its surface.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIG. 1 illustrates apparatus in accordance with the principles of the present invention that enhances removal of contaminating particles from a surface of a non-electrostatically sensitive component or substrate that is cleaned using a carbon dioxide cleaning spray; and FIG. 2 illustrates one method of removing contaminating particles from a surface of a non-electrostatically sensitive component or substrate that is cleaned using a carbon dioxide cleaning spray.

DETAILED DESCRIPTION

Referring to the drawing figures, FIG. 1 illustrates apparatus 10 in accordance with the principles of the present invention that enhances removal of contaminating particles from a surface 11 of a non-electrostatically sensitive component 12 or substrate 12 that is cleaned using a carbon dioxide cleaning spray 13. The contaminating particles are bound by strong electrostatic forces to the surface 11 of the non-electrostatically sensitive component 12 or substrate 12.

The apparatus 10 comprises a computer 14 that is coupled to a programmable power supply 15 that has its outputs 16, 17 coupled to ground and to the non-electrostatically sensitive component 12 or substrate 12 that is to be cleaned using the carbon dioxide cleaning spray 13. The carbon dioxide cleaning spray 13 may be a carbon dioxide jet spray 13 generated by a jet spray gun 18 (or nozzle and orifice combination 18) fed from a pressurized liquid carbon dioxide tank 19 to generate a spray 13 of $CO_2$ snow containing solid aerosol particles and gas. The present invention generates an electrostatic force that is used to repel small contaminating particles from the surface 11 of the contaminated component 12 or substrate 12 during carbon dioxide spray cleaning.

The surface charge of the component 12 or substrate 12 is determined by cleaning the surface 11 with the carbon dioxide spray 13 without adding any voltage or charge bias to the component 12 or substrate 12. Then the surface 11 is biased with a voltage having the opposite polarity by a large amount. The computer 14 may be used to program the programmable power supply 15 to appropriately reverse bias the component 12 or substrate 12. The surface 11 is then cleaned a second time with the carbon dioxide spray 13, which removes the particles that were bound to the surface 11 by electrostatic forces generated during the first cleaning.

The present invention must be able to bias the surface 11 of the component 12 or substrate 12 both positively and negatively, because materials that make up the component 12 or substrate 12 charge according to their relative positions on the Triboelectric scale relative to the position of the carbon dioxide spray 13 on the Triboelectric scale. Materials such as Teflon, for example, may exhibit thousands of volts of static charge build-up after cleaning. In contrast, metals typically have much less static charge build-up. Reversing the polarity of the charge on the surface 11 that is to be cleaned removes the strong attraction between the contaminating particles and the surface 11 and enhances removal of the contaminating particles from the surface 11.

FIG. 2 illustrates one method 20 of removing contaminating particles from a surface 11 of a non-electrostatically sensitive component 12 or substrate 12 that is cleaned using a carbon dioxide cleaning spray 13. The present method 20 comprises the following steps. A non-electrostatically sensitive component 12 or substrate 12 that is to be cleaned using a carbon dioxide cleaning spray 13 is connected 21 to a programmable power supply 15. The non-electrostatically sensitive component 12 or substrate 12 is then cleaned 22 a first time using the carbon dioxide cleaning spray 13 without adding any voltage or charge bias to the component 12 or substrate 12. The programmable power supply 15 is then programmed to reverse bias 23 the surface 11 of the non-electrostatically sensitive component 12 or substrate 12 with a predetermined amount of voltage or charge. The programming may be implemented by appropriately programming 25 the computer 14. The amount of voltage or charge applied to the component 12 or substrate 12 depends upon the material from which it is made. The reversed-biased, non-electrostatically sensitive component or substrate is then cleaned 24 a second time using the carbon dioxide cleaning spray 13, which removes contaminating particles from its surface 11.

Thus, an apparatus and method of enhancing the removal of contaminating particles on surfaces of a non-electrostatically sensitive components or substrates when they are cleaned using a cryogenic aerosol cleaning spray have been disclosed. It is to be understood that the described embodiments are merely illustrative of some of the many specific embodiments which represent applications of the principles of the present invention. For example, additional cryogenic aerosols such as nitrous oxide, argon and xenon may be used in certain applications instead of a carbon dioxide spray. Clearly, numerous and other arrangements can be readily devised by those skilled in the art without departing from the scope of the invention.

What is claimed is:

1. An apparatus for cleaning a surface of a component, said apparatus comprising:

a) a carbon dioxide cleaning spray device for generating a carbon dioxide cleaning spray at a first time to clean the surface of the component, wherein said cleaning spray device generates a first static charge on the surface of the component during a first cleaning; and b) a programmable power supply that has outputs respectively coupled to ground and to the component for selectively biasing the component with a second static charge which is opposite in polarity to said first static charge generated during said first cleaning of the component by the carbon dioxide cleaning spray device, wherein said second static charge reverses the polarity of the first static charge on the surface of the component, such that contaminating particles bound to the surface of said component are released, and wherein the carbon dioxide cleaning spray device generates said carbon dioxide cleaning spray a second time to clean the component during a second cleaning, such that said second cleaning removes said contaminating particles from said surface.

2. The apparatus of claim 1, further comprising a computer that is coupled to a programmable power supply for controlling the amount of bias applied to the component by the programmable power supply.

3. A method of cleaning a surface of a component using a cleaning spray device that generates a carbon dioxide cleaning spray, said method comprising:

a) providing a cleaning spray device for generating a carbon dioxide cleaning spray;

b) connecting a component to a programmable power supply;

c) cleaning the component a first time using the carbon dioxide cleaning spray, thereby generating a first charge on the surface of the component as a result of cleaning the first time with said carbon dioxide cleaning spray;

d) monitoring the first charge to determine an amount and polarity of the first charge that is generated by the carbon dioxide cleaning spray; and e) applying a reverse bias to the component by said programmable power supply to produce a second charge which is opposite in polarity to the first charge, wherein said second charge reverses the polaity of the first charge on the surface of the component, such that contaminating particles bound to the surface of said component are released;

f) cleaning said component a second time using said carbon dioxide cleaning spray to remove said contaminating particles present on said surface.

* * * * *

UNITED STATES PATENT AND TRADEMARK OFFICE

CERTIFICATE OF CORRECTION

PATENT NO. : 6,146,466
DATED : November 14, 2000
INVENTOR(S) : Charles W. Bower

It is certified that error appears in the above-identified patent and that said Letters Patent is hereby corrected as shown below:

On the title page,
[22] Filed: October 4, 1996

Signed and Sealed this

Twenty-ninth Day of May, 2001

Nicholas P. Godici

*Attest:*

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,146,466
DATED : November 14, 2000
INVENTOR(S) : Charles W. Bower

It is certified that error appears in the above-identified patent and that said Letters Patent is hereby corrected as shown below:

[22] Filed: October 4, 1996

Signed and Sealed this

Third Day of July, 2001

*Attest:*

Nicholas P. Godici

*Attesting Officer*

NICHOLAS P. GODICI
*Acting Director of the United States Patent and Trademark Office*